United States Patent [19]

Mellott

[11] Patent Number: 4,677,796

[45] Date of Patent: Jul. 7, 1987

[54] SHELTER STRUCTURE

[76] Inventor: John A. Mellott, Indian Hills, P.O. Box 34B, Mountain Center, Calif. 92361

[21] Appl. No.: 919,508

[22] Filed: Oct. 16, 1986

Related U.S. Application Data

[63] Continuation of Ser. No. 864,423, May 19, 1986, abandoned.

[51] Int. Cl.[4] ..... E04B 1/34; E04B 7/00; A45F 1/00

[52] U.S. Cl. ..... 52/73; 52/81; 52/82; 135/99; 135/101; 135/102

[58] Field of Search ..... 52/3, 63, 73, 80, 81, 52/82; 135/101, 102, 99, DIG. 9

[56] References Cited

U.S. PATENT DOCUMENTS

| | | | |
|---|---|---|---|
| 199,353 | 1/1878 | Clark | 52/82 |
| 359,749 | 3/1887 | Tourgee | 52/63 |
| 799,544 | 9/1905 | Dennis | 52/639 |
| 2,932,304 | 4/1960 | Voege et al. | 135/99 X |
| 3,090,162 | 5/1963 | Baroni | 52/73 X |
| 3,633,325 | 1/1972 | Bartoli | 52/73 |
| 3,768,216 | 10/1973 | Shirota et al. | 52/73 |
| 3,810,481 | 5/1974 | Nohmura | 135/98 X |
| 4,265,059 | 5/1981 | Johnson | 52/73 X |
| 4,335,558 | 6/1982 | Caldwell et al. | 52/73 X |
| 4,540,010 | 9/1985 | May | 135/99 |

FOREIGN PATENT DOCUMENTS

| | | | |
|---|---|---|---|
| 137613 | 6/1950 | Australia | 52/82 |
| 569810 | 2/1959 | Canada | 135/102 |
| 3418994 | 11/1985 | Fed. Rep. of Germany | 52/63 |
| 125,648 | 5/1919 | United Kingdom | 52/82 |
| 593,200 | 10/1947 | United Kingdom | 52/82 |

*Primary Examiner*—Alfred C. Perham
*Attorney, Agent, or Firm*—Irving Keschner

[57] ABSTRACT

An inexpensive, expandable and easily erected shelter structure. The structure comprises a multi-sided roof supported by a single center upright, the roof being assembled using metal tubes and fittings. A center member is attached to the top end of the upright, the center member supporting a plurality of short tubes for receiving the corresponding ends of a plurality of elongated tube members. The other end of the elongated tube members are each connected to a fitting, each fitting also receiving the ends of two peripheral tubes. The other end of the upright is placed in a pipe sleeve anchored in the ground. A mechanism is provided to secure the roof to the center member. Two or more shelters can be easily interconnected to form larger structures with a minimum of ground support required.

17 Claims, 9 Drawing Figures

SHELTER STRUCTURE

CROSS-REFERENCE TO RELATED APPLICATION

This is a continuing application of application Ser. No. 864,423 filed May 19, 1986 now abandoned.

BACKGROUND OF THE INVENTION

1. Field of the Invention

The present invention relates to an improved shelter structure which requires a single center upright, two or more structures being easily interconnected to form larger structure assemblies with minimum ground support.

2. Description of the Prior Art

Simple structures for providing shelter have long been available in the prior art. For example, shelter for livestock, such as horses, has been a requirement for hundreds of years. Recently, many individuals have purchased livestock, particularly horses, for recreational or business purposes. The animals have been either maintained on the purchaser's residential grounds (if the local zoning laws permit), at privately owned stables, or other land to which the purchaser has access.

If the purchaser's land does not have the facilities to shelter the animals from the elements, the need then is to provide the appropriate animal shelter. The simplest shelter comprises a structually supported roof, the cost of prior art shelters being attributable in part to the extent of the ground support required and the nature of the terrain.

Typical of prior art structures are those disclosed in the following United States patents:

U.S. Pat. No. 3,810,481 to Nohumura discloses a tent configuration which does not require a center pole, a plurality of end members and ribs being utilized, the design being arranged such that a plurality of tents could be interconnected; U.S. Pat. No. 3,633,325 to Bartoli discloses a building structure which has a central support column, triangular roof sections, rafter members, horizontal members, vertical posts and a concentrically formed concrete foundation wall; U.S. Pat. No. 2,932,304 to Voege et al discloses a tent construction which enables a series of tents to be fastened together in tandem and includes a vertical support and plurality of triangular roof sections; and U.S. Pat. No. 4,540,010 to May discloses a portable knock-down canopy including a central support post and a plurality of frame connectors.

The aforementioned references, other than Bartoli, describe non-permanent structures in the sense that the tent structures are collapsible and portable. Bartoli, although disclosing a permanent structural design, is designed as a single, relatively large structure which is capable of being constructed on various types of terrain.

What is desired is to provide a simple, inexpensive, permanent, structurally strong and easily constructed shelter structure configuration designed in a manner such that two or more of the structures can be interconnected to form larger structures with a minimum of ground support.

SUMMARY OF THE PRESENT INVENTION

The present invention provides a shelter structure which is inexpensive and simple to erect. The structure comprises a multi-sided member supported by a single center upright, the member being assembled using, in one embodiment, metal tubes and fitting. A center member is attached to the upright, the center member supporting metal tubes one end of each tube being connected to a corresponding fitting, the ends of two peripheral tubes being connected to each fitting. The upright is placed in a pipe sleeve anchored in the ground, a mechanism being provided to secure roof sections to the center member. Two or more shelters can be easily interconnected to form a larger shelter structure assembly with a minimum of ground support required.

The shelter structure of the present invention is permanent in one sense in that it is comprised of strengthened materials, such as metal or plastic pipes; it is temporary in a second sense in that the shelter structure is designed so as to be easily disassembled for erection at another site. In addition, two or more of the shelter structures can be interconnected to form larger shelter structure assemblies enabling sizeable areas to be sheltered with a minimum of ground support. Further, the structures can be joined in a manner such that the number of vertical supports required is less than the number of structures joined. The use of tubular fittings and pre-cut lengths of pipe/tubing allows the shelter structure to be disassembled into easily transported elements. The roof sections may be made of a variety of materials, including wood and molded plastic.

The shelter structure of the present invention has a number of uses in addition to its primary use as a pasture shelter for horses. In particular, the structure can be used as a barn, small livestock shelter, a storage facility, gazebos, as a shelter on golf courses and beaches, etc.

BRIEF DESCRIPTION OF THE DRAWINGS

For better understanding of the present invention as well as other objects and further features thereof, reference is made to the following description which is to be read in conjunction with the accompanying drawing wherein.

DETAILED DESCRIPTION OF THE INVENTION

Figure 1:
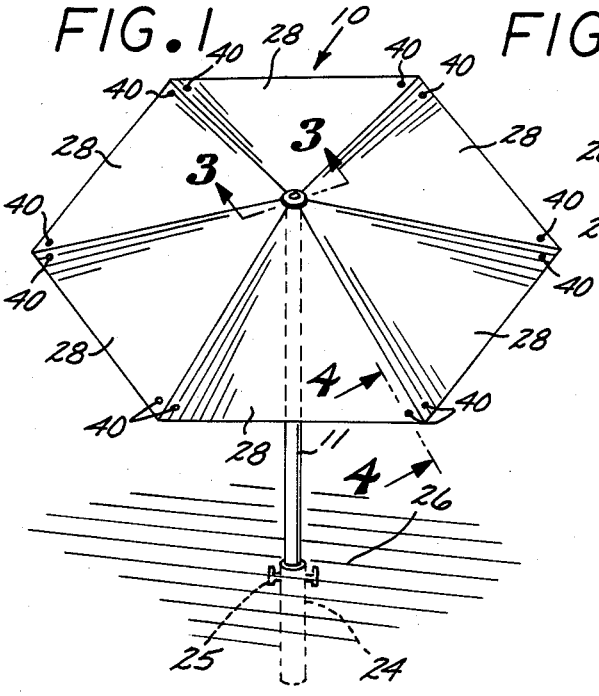
FIG. 1 is a perspective view of the shelter structure of the present invention.
Figure 2:
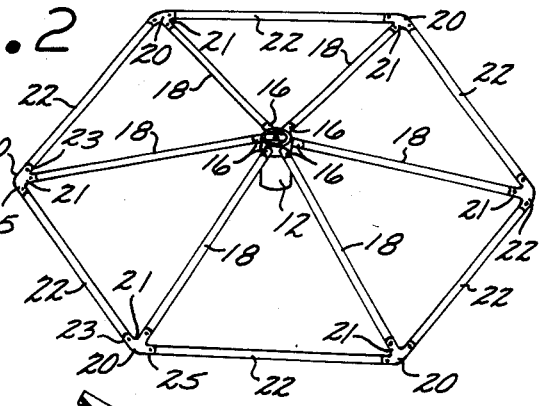
FIG. 2 is a perspective view of the upper portion of the shelter structure of the present invention with the roof panels removed.
Figure 4:
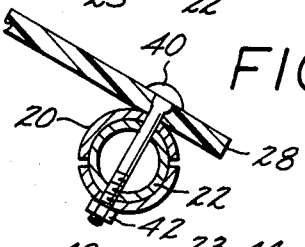
FIG. 4 is a sectional view along line 4—4 of FIG. 1.
Figure 3:
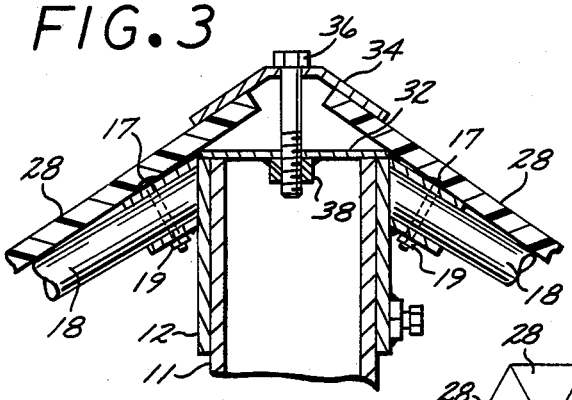
FIG. 3 is a sectional view along line 3—3 of FIG. 1.

Referring now to FIG. 1, a perspective view of the shelter structure 10 of the present invention is illustrated. Structure 10 comprises a vertically extending upright pipe member 11 having a short cylindrical piece 12 fitted or otherwise secured on one end thereof. Piece 12, typically twenty inches in height, supports a plurality of short tubes, or receiving members, 16 attached to its circumference. In a preferred embodiment, one end of each of six short tubes, or stubs, 16 are secured, such as by welding, to member 12. The ends of each of six tubes 18 are inserted into the corresponding openings in the other end of tubes 16 in a manner as illustrated in FIG. 2. In a preferred embodiment, the ends of tubes 18 and fitted into the openings in tubes 16 and secured therein by bolts 17 and nuts 19 (FIG. 3), the tubes radiating downwardly at an angle (typically 12 degrees) to vertical member 11. The other ends of tubes 18, in one arrangement, are each positioned in one of the openings in an upwardly extending portion 21 of female fitting 20 as shown in FIG. 2. Each of the fittings 20 have two additional portions 23 and 25 extending at an angle from the first extension, the extensions having openings therein to receive two ends of a plurality of peripheral tubes 22. In an alternate arrangement, portions 21, 23 and 25 of fitting 20 are designed for insertion (male fitting) into corresponding openings formed in the ends of tubes 18 and peripheral tubes 22. When the peripheral tubes are properly positioned, the upper portion of the shelter structure 10 of the present invention is as shown in FIG. 2. In the preferred embodiment, six tubes 18, six fittings 20 and six peripheral tubes 22, are utilized to form a shelter structure having a six-sided roof portion. The tubes 18, fittings 20 and peripheral tubes 22 may comprise metal, such as steel, or plastic. The other end of member 11 is removably positioned in a pipe sleeve 24 which is anchored in the ground 26, member 11 being secured to sleeve 24 by set bolt 25 to prevent member 11 from rotating in sleeve 24. Preferably, set bolt 25 is positioned below ground level as illustrated. A plurality of roof sections 28 (six in the embodiment illustrated) are positioned over the open sections 30 (FIG. 2) to shelter the area therebelow. The roof sections 28 are secured to roof structure in the manner shown in FIGS. 3 and 4. Although not illustrated, a plurality (six in the embodiment illustrated) of pipe members may be coupled between the bottom of piece 12 and each of peripheral tubes 22 (preferably in the center of each tube 22) to provide further support for the shelter structure and minimize the possibility of structure deflection in high winds. Referring to FIG. 3, each roof section 28 (typically made of wood although plastic and other materials could be utilized) is sized in a manner such that they abut adjacent roof sections and overlap a portion of the peripheral tubes 22. A plate member 32 having an opening therein is welded to the upper end of pipe 12 as illustrated. A second plate member 34 having an opening therein is positioned over the roof sections 28 as illustrated. A bolt 36 and nut 38 are then utilized to sandwich the tubes 18 and roof sections 28 in a secured manner as illustrated. The bottom edges of roof sections 28 are secured to peripheral tubes 28 via bolts 40 and nuts 42 as shown clearly in the cross-sectional view of FIG. 4. In the preferred embodiment, the peripheral tubes 22 are positioned approximately eight feet above the ground.

Figure 5:
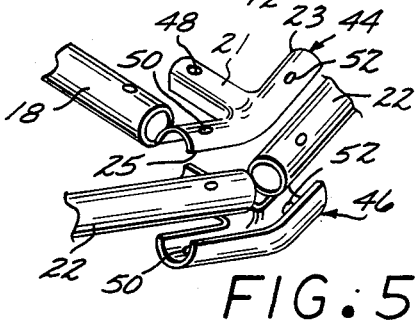
FIG. 5 is an exploded view illustrating the coupling elements utilized in the present invention.

FIG. 5 illustrates one technique for joining tubes 18 to peripheral tubes 22. In particular, fitting 20 may comprise formed metal parts, or stampings, 44 and 46 or parts molded from plastic having holes 48, 50, and 52 formed therein. Bolts 40 (only one shown) extend through holes 50 and 52 to simultaneously secure together (with nuts 42) the bottom of roof sections 28 and the ends of peripheral tubes 22. Similarly, bolts (not shown) extend through holes 48 to secure tubes 18 to fittings 20. The same joining technique can be utilized in the male arrangement of fitting 20. The joining technique can be utilized in the male arrangement of fitting 20. The elements of the shelter structure may be joined in other ways, including welding or a combination of welding and formed metal parts.

Figure 6:
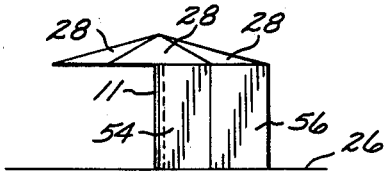
FIG. 6 is an elevation view illustrating the shelter structure of the present invention which incorporates full length siding members.

FIG. 6 is simplified elevation view illustrating the use of siding members 54 and 56 (although only two siding members are illustrated, any number up to six in the embodiment shown may be utilized) to enclose a portion or all of the shelter structure 10. Although not shown, the upper edge of the siding members may be secured to peripheral tubes 22 by any conventional technique, including the use of clamping members.

Figure 7:
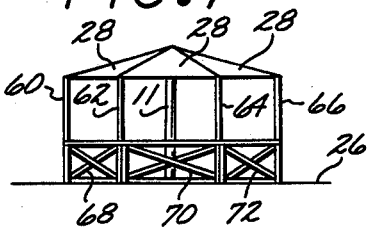
FIG. 7 is an elevation view illustrating the shelter structure of the present invention which incorporates siding members.

FIG. 7 is a simplified elevation view illustrating the use of vertically extending support members 60, 62, 64 and 66 which are utilized so that, for example, gates or enclosure means 68, 70 and 72 can be mounted thereto as illustrated.

Figure 8:
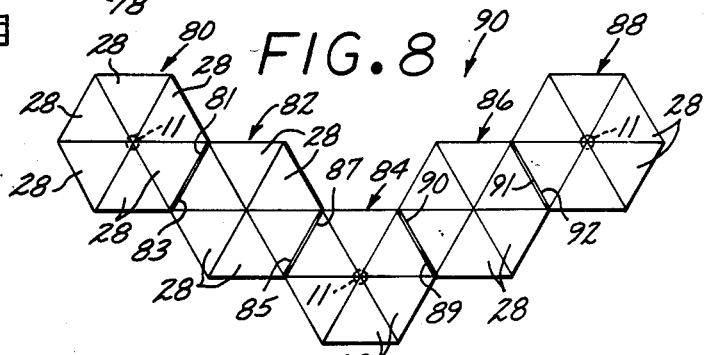
FIG. 8 is a simplified plan view illustrating a first embodiment of a shelter assembly of the present invention.

FIG. 8 is a simplified plan view illustrating the joining of five shelter structures 80, 82, 84, 86 and 88 to form assembly 90 such that sizeable areas may be sheltered with a minimum of ground support. In this embodiment, edge 81 of structure 80 is attached or otherwise secured to edge 83 of structure 82; edge 85 of structure 82 is attached to side 87 of structure 84; side 89 of structure 84 is attached to side 90 of structure 86; and side 91 of structure 86 is attached to side 92 of structure 88. The sides may be attached together by any conventional technique, including the use of clamps, bolts, etc. It has been determined that the number of vertical upright members 11 required in assemblies of shelter structures may be less than the number of shelter structures, the only criteria being that at least two sides, or edges, of the structure not having the vertical upright member must be attached to adjacent sides, or edges, of other shelter structures having a vertical upright member. In this context, structures 80, 84 and 88 are shown as incorporating vertical upright, or support, member 11 whereas structures 82 and 86 do not incorporate members 11 (it should be noted that structure 84, although shown as incorporating member 11, can be supported without vertical member 11). It should be noted that all of the roof sections 28 are not referenced in FIGS. 8 and 9 for illustrative purposes.

Figure 9:
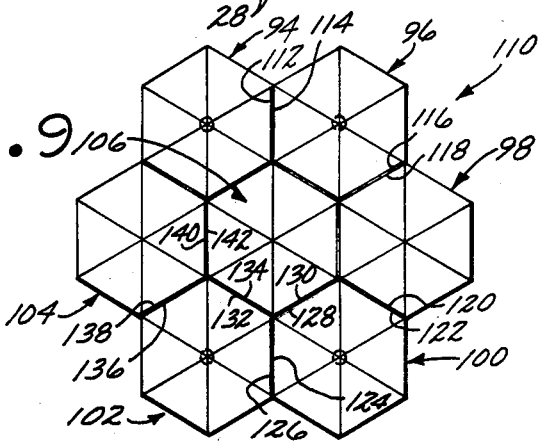
FIG. 9 is a simplified plan view illustrating a second embodiment of a shelter assembly of the present invention.

FIG. 9 is a simplified plan view illustrating the joining of seven shelter structures 94, 96 . . . 106 to form a shelter assembly 110 having a design different than that shown in FIG. 8. In this embodiment, edge 112 of structure 94 is attached to edge 114 of structure 96; edge 116 of structure 96 is attached to edge 118 of structure 98; edge 120 of structure 98 is attached to edge 122 of structure 100; edge 124 of structure 100 is attached to edge 126 of structure 102; edge 128 of structure 100 is attached to edge 130 of structure 106; edge 132 of structure 102 is attached to edge 134 of structure 106; edge 136 of structure 102 is attached to edge 138 of structure 104; edge 140 of structure 104 is attached to edge 142 of structure 106 and so on. In the embodiment illustrated, only structures 94, 96, 100 and 102 require vertical upright member 11.

The present invention thus provides a relatively simple, multipurpose shelter structure which can be joined in a manner such that sizeable may be sheltered with a minimum of ground support and without the necessity of "squaring" the roof when th structure is erected on uneven terrain. The shelter has many uses including a pasture shelter for horses, barns, small livestock shelter, shade areas on golf courses, tool sheds, etc. The structure is designed so as to be easily dissembled for erection at another site since in the preferred embodiment the structure is comprised of tubular fittings and pre-cut lengths of pipe.

Although the invention disclosed herein is directed primarily to the shelter structure itself and not to the type of material that comprises roof sections 28, the roof sections may comprise wood (plywood) panels of various shapes and sizes, molded plastic roof panels, etc. In addition, the roof sections may be replaced by an essentially integral unit which would enclose open sections 30.

While the invention has been described with reference to its preferred embodiments, it will understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A shelter structure comprising:

a member extending in the vertical direction;

means associated with one end of said vertically extending member having a plurality of openings therein for receiving corresponding ends of a first set of a plurality of elongated members;

a plurality of fitting members, each of said fitting members having at least three portions associated therewith, the other ends of said first set of elongated members each being coupled to one portion in a corresponding fitting member;

a second set of plurality of elongated members, one end of each elongated member being coupled to another portion of one of said fitting members, the other end of said elongated member being coupled to another portion of a adjacent fitting member, the coupling of said second set of elongated members resulting in a connected, multi-edged side member; said side member and the connected first set of elongated members forming a series of inclined open sections; and means for substantially enclosing each of said inclined open sections.

2. The structure of claim 1 wherein said first set of elongated members extend downwardly from the horizontal at a predetermined angle.

3. The structure of claim 1 further including a receptacle member positioned in the ground, the other end of said vertically extending member being positioned in said receptacle member.

4. The structure of claim 3 wherein said multi-edged side member is positioned a predetermined distance above the ground.

5. The structure of claim 4 further including a siding member coupled to one edge of said multi-edged side member.

6. The structure of claim 1 further including a plurality of upright members extending between said multi-edge side member and the ground.

7. The structure of claim 6 further including a siding member connected between adjacent upright members.

8. The structure of claim 1 wherein said enclosing means comprise wood panels.

9. A shelter assembly comprising a first shelter structure comprising a first member extending in the vertical direction, means associated with one end of said vertically extending member having a plurality of openings therein for receiving corresponding ends of a first set of a plurality of elongated members, a plurality of fitting members each of said fitting member having at least three portions associated therewith, the other ends of said first set of elongated member each being coupled to another portion of a corresponding fitting member; a second set of a plurality of elongated members, one end of each elongated member being coupled to another portion of said fitting members, the other ends of aid elongated member being coupled to another portion of an adjacent fitting member, the coupling of said second set of elongated members resulting in a connected, first multi-edged side member; said side member and the connected first set of elongated members forming a series of inclined open sections, and means for substantially enclosing each of said inclined open sections;

a second shelter struture comprising a second member extending in the vertical direction, means associated with one end of said vertically extending member having a plurality of openings therein for receiving corresponding ends of a first set of a plurality of elongated members, a plurality of fitting members each of said fitting members having at least three portions associated therewith, the other ends of said first set of elongated members each coupled to one portion of a corresponding fitting member, a second set of a plurality of elongated members, one end of each elongated member being coupled to another portion of one of said fitting members, the other end of said elongated member being coupled to another portion of an adjacent fitting member, the coupling of said second set of elongated members resulting in a connected, second multi-edged side member, said side member and the connected first set of elongated members forming a series of inclined open sections, and means for substantially enclosing each of said inclined open sections; and means for coupling at least one edge of said first shelter structure to an adjoining edge of said second shelter structure.

10. The shelter assembly of claim 9 further including a third shelter structure comprising means having a plurality of openings therein for receiving corresponding ends of a first set of a plurality of elongated members, a plurality of fitting members each of said fitting members having at least three portions associated therewith, the other ends of said first set of elongated members each being coupled to one portion of a corresponding fitting member, a second set of a plurality of elongated members, one end of each elongated member being coupled to another portion of one of said fitting members, the other end of said elongated member being coupled to another portion of an adjacent fitting member, the coupling of said second set of elongated members resulting in a connected, third multi-edged side member; said side member and the connected first set of elongated members forming a series of inclined open sections, and means for substantially enclosing each of said inclined open sections, a first edge of said third shelter structure being coupled to an adjacent edge of said first shelter structure, a second edge of said third shelter structure being coupled to an adjoining edge of said second shelter structure.

11. The shelter assembly of claim 10 wherein said first sets of elongated members extend downwardly from the horizontal at a predetermined angle.

12. The shelter assembly of claim 10 further including first and second receptacle members positioned in the ground, the other ends of said first and second vertically extending members being positioned in said first and second receptacle, respectively.

13. The shelter assembly of claim 10 wherein said first, second and third multi-edged side members are positioned a predetermined distance above the ground.

14. The shelter assembly of claim 13 further including a siding member coupled to one edge of said first multi-edged side member.

15. The shelter assembly of claim 13 further including a plurality of upright members extending between said first, second and third multi-edged side members and the ground.

16. The shelter assembly of claim 15 further including at least one siding member connected between adjacent upright members of said first multi-edged side member.

17. The shelter assembly of claim 9 wherein said enclosing means comprise wood panels.

* * * * *